United States Patent [19]

Hulligan

[11] 4,071,991

[45] Feb. 7, 1978

[54] SLIP JOINT FOR DISPOSAL CHUTE

[75] Inventor: Jeffrey A. Hulligan, North Olmsted, Ohio

[73] Assignee: J. P. Suggins Mobile Welding, Cleveland, Ohio

[21] Appl. No.: 781,638

[22] Filed: Mar. 28, 1977

[51] Int. Cl.[2] ..... B65D 91/00

[52] U.S. Cl. ..... 52/204; 232/43.2

[58] Field of Search ..... 52/204, 173.05; 14/71, 14/72; 232/43.2, 43.3, 44; 100/227 A

[56] References Cited

U.S. PATENT DOCUMENTS

| | | | |
|---|---|---|---|
| 1,596,553 | 8/1926 | Potter | 52/204 |
| 2,177,328 | 10/1939 | Pender | 232/44 |
| 2,581,621 | 1/1952 | Behrens | 232/44 |
| 2,792,171 | 5/1957 | Rosset | 232/43.3 |
| 2,842,308 | 7/1958 | Massengill | 232/44 |
| 3,554,345 | 1/1971 | Mullens | 232/43.2 |
| 3,695,175 | 10/1972 | Baasenbach | 100/229 A |

OTHER PUBLICATIONS

The Dempster SP42-90, received by P.O., Oct. 23, 1968.

*Primary Examiner*—Ernest R. Purser
*Assistant Examiner*—Henry Raduazo
*Attorney, Agent, or Firm*—Ronald R. Stanley

[57] ABSTRACT

A disposal chute for waste paper, cardboard, and other packing materials is disclosed which is intended to temporarily connect a container to a building. The disposal chute is permanently positioned adjacent to the building. A slip joint construction connects the chute to the building in such a manner as to completely enclose the mating surfaces while allowing relative movement between the chute and the building. The mating surface at the building is designed so that the relative movement does not adversely affect the brick and mortar construction of the building surrounding the opening for the chute. A container, which may be removed and replaced relatively often, is positioned adjacent to the chute to be in communication with the building. The placing and removing of the container results in the relative movement between the chute and the building.

9 Claims, 4 Drawing Figures

SLIP JOINT FOR DISPOSAL CHUTE

BACKGROUND OF THE INVENTION

The present invention relates generally to the collection of scrap or waste materials and, more particularly, to the connection of a chute and an opening in a building to allow the passage of scrap or waste materials while preventing damage to the building due to impact.

Dumpsters or such other containers have long been used for the collection of scrap or waste materials at or near the source of the waste. In the particular situation of commercial establishments, scrap paper is a major concern. Generally, in commercial situations the scrap container is located at some point exterior to the building. This arrangement is preferred in order that collection of the scrap be easily accomplished. While the further the container is from the building, the better, for collection and space restriction reasons, the container would be more conveniently positioned adjacent to or in the building.

The collection of the scrap is accomplished by means of physically removing the container and replacing it with an empty, different container. Clearly, special equipment is necessary to lift or slide the container from its position when full. Access to the container by the special equipment imposes space limitations with regard to surrounding structures. The removal and, more importantly, the replacement of the containers often subjects any attached or surrounding structures to considerable jostling.

In order to locate the container within the building, a severe limitation is imposed on the size of the container so that the container and special equipment for transportation thereof fit through the building openings. Also, relatively expensive, interior space is wasted.

The preferred arrangement is for the container to be exterior to the building while being accessible from within the building. It is also considered advantageous to hinder the influx of exterior environment into the building or the container. While this purpose, is easily accomplished by reason of a cover or chute connecting the building and the container, at least one disadvantage is encountered by this solution. In this regard, the jostling of the container resulting from the removal or replacement of the container is transferred to the building.

SUMMARY OF THE INVENTION

The present invention has as a primary object the provision of a new and unique scrap or waste collection system.

Another object of the present invention is the provision of a new and unique waste collection system which allows access to a temporary receptacle positioned exterior to a building from the interior of the building while preventing or limiting the influx of the exterior environment.

Yet another object of the present invention is the provision of a new and unique waste collection system which includes a sealing, shock absorbing connection between a temporary receptacle and a building wall.

These and other objects and advantages of the invention will appear from the following description of preferred forms thereof, reference being made to the accompanying drawings.

DETAILED DESCRIPTION OF THE PREFERRED EMBODIMENT

Figure 1:
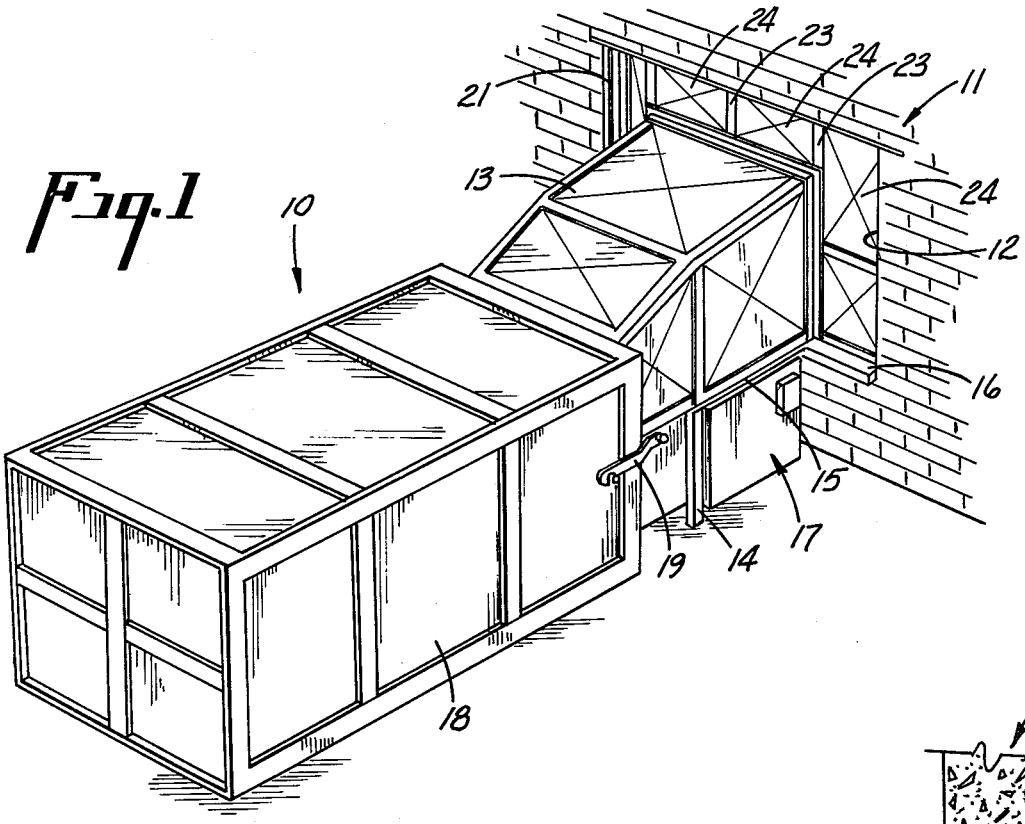
FIG. 1 is a perspective view of a waste collection system including an embodiment of this invention.

Scrap material, particularly waste paper, produced or accumulated within a building, such as a commercial business establishment, is desired to be placed in a temporary receptacle or container without inconvenience and loss of time due to a person leaving the building carrying the waste being discharged. FIG. 1 illustrates a disposal system, indicated generally at 10, accomplishing the desired objects of the present invention.

A building, indicated generally at 11, has a doorway 12 for the intended purpose of allowing ingress and egress to the building. A chute 13 constructed of angle iron and sheet metal is positioned with an open end within the doorway 12. The chute 13 is supported above the ground level by pillars 14 so that the floor 15 of the chute is at the same level as the floor 16 within the building 11. A packer, indicated generally at 17, is positioned beneath the chute 13 at ground level.

A dumpster, container or receptacle 18 is shown positioned immediately adjacent to the chute 13 and packer 17. Latching arms 19 (only one shown) one on each side, secure the dumpster 18 to the chute 13 and packer 17. The purpose in the latching arms 19 is to prevent separation of the dumpster 18 and chute 13 as the packer 17 applies pressure to force scrap into the dumpster. The dumpster 18 is unlatched and removed when filled, with another dumpster being repositioned. The chute 13, packer 17, and dumpster 18 are arranged so that the scrap remains interior and shielded from the exterior environment.

A particularly unique feature of the disposal system 10 in FIG. 1 is the connection of the chute 13 to the doorway 12 of the building. The building 11 shown in FIG. 1 is a brick or masonry construction and is chracteristic of commercial type buildings. Clearly, if the dumpster 18 is jostled to any great degree as it is being positioned adjacent to the chute 13, any contact with the chute is transposed directly to the building 11. Such shocks, which often are relatively large, would result in permanent damage to the masonry if the chute 13 were capable of direct contact with the building.

In order to eliminate or minimize any damage to the building, the doorway 12 is purposely designed to be larger than the chute 13. Since an object of this invention is to seal the interior of the building from the exterior environment, the area between the doorway 12 and chute 13 must be closed. An outer metal frame 12, constructed from material such as angle iron, is secured to the doorway 12 of the building 11 as by bolting or another suitable means. An inner metal frame 22, likewise constructed from material such as angle iron, is of a size just larger than the end of the chute 13 which is adjacent to the doorway 12.

The inner 22 and outer 21 metal frames are connected by reason of metal supports 23, again constructed of material such as angle iron, and sheet metal panels 24. Thus the sheet metal and angle iron structure seals the doorway 12 and chute 13 in accordance with the objects of this invention.

Figure 2:
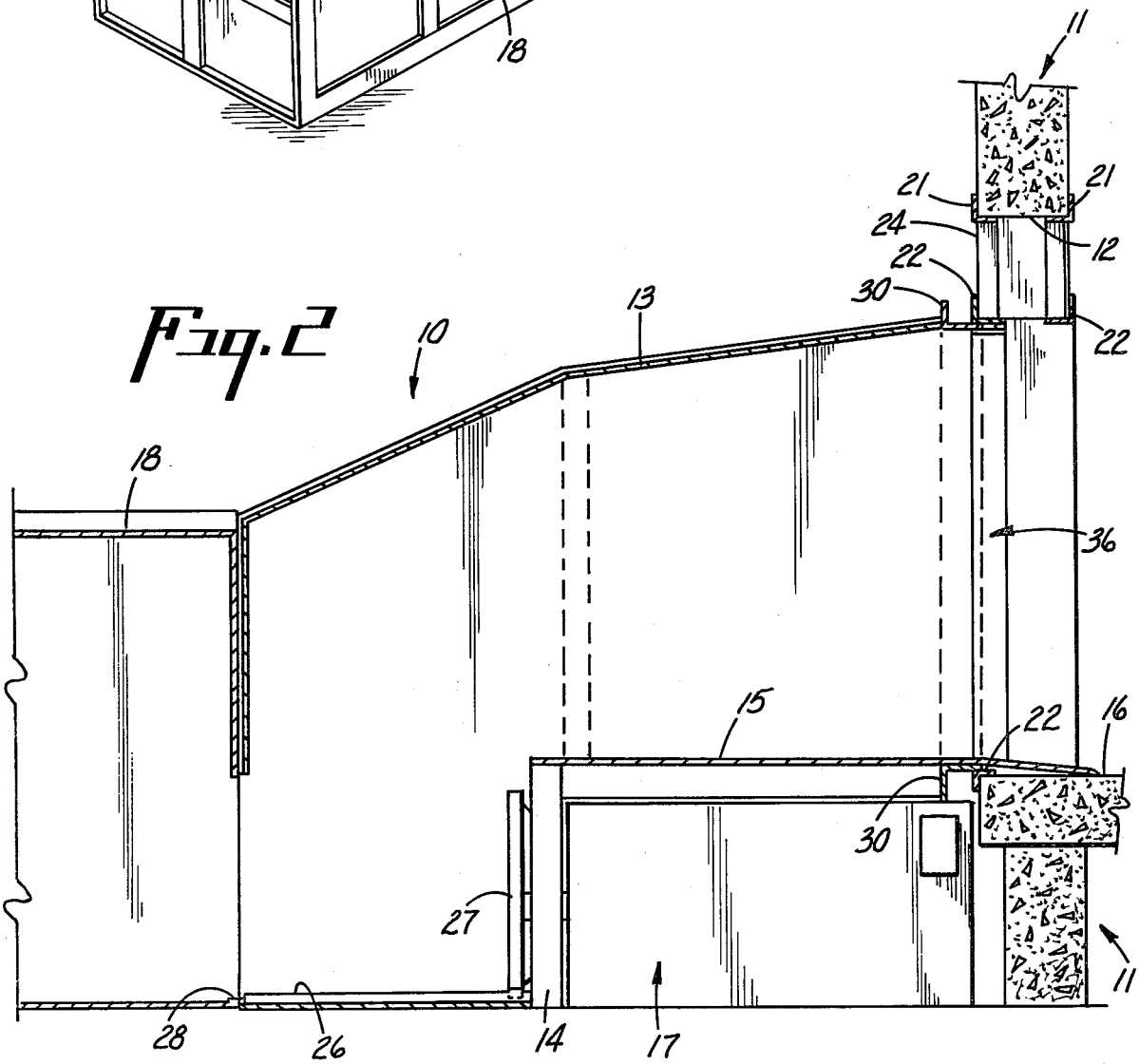
FIG. 2 is a cross-sectional view of the waste collection system shown in FIG. 1, further illustrating the details of the system.

FIG. 2 is useful in explaining the operation of the disposal system 12 and clarifying the details of the connection of the chute 13 to the building 11. An occupant of the building, in order dispose of scrap, need only carry the scrap through the doorway 12 into the chute 13 and drop the scrap into a well 26 below the end of the chute 13. At an appropriate time, upon command of an operator, the packer 17 causes a bulkhead 27 to be forced across the well 26 and into the dumpster 18 through an opening 28 at the bottom edge thereof. The bulkhead 27 is moved by a hydraulic cylinder (not shown) or any other suitable means. As the bulkhead 27 is moved into the dumpster 18, any scrap in the well 26 is forced into the dumpster 18. The movement of the bulkhead 27 is also capable of compacting the scrap to some degree.

As may be appreciated from a view of FIG. 2, when the dumpster 18 is removed and replaced, considerable movement of the chute 13 can be expected. The inner 22 and outer 21 metal frames, supports 23 and sheet metal panels 24 absorb considerable movement of the chute 13 with only flexing and thus prevent permanent damage to the building 11.

The open end of the chute 13 has affixed thereto a metal frame 30, again preferably constructed of material such as angle iron, which is designed to be just slightly smaller in dimensions than the inner metal frame 22. As shown in FIG. 2, the metal frame 30 and chute 13 are inserted partially into the inner metal frame 22 in the static condition of the disposal system 10. The floor 15 of chute 13 is constructed of a relatively heavy gauge metal which is intended to support personnel or vehicles entering the chute dispose of scrap. The floor 5 continues over the frame 30 and into the building a sufficient distance to protect the inner frame 22 and act as a ramp.

Figure 3:
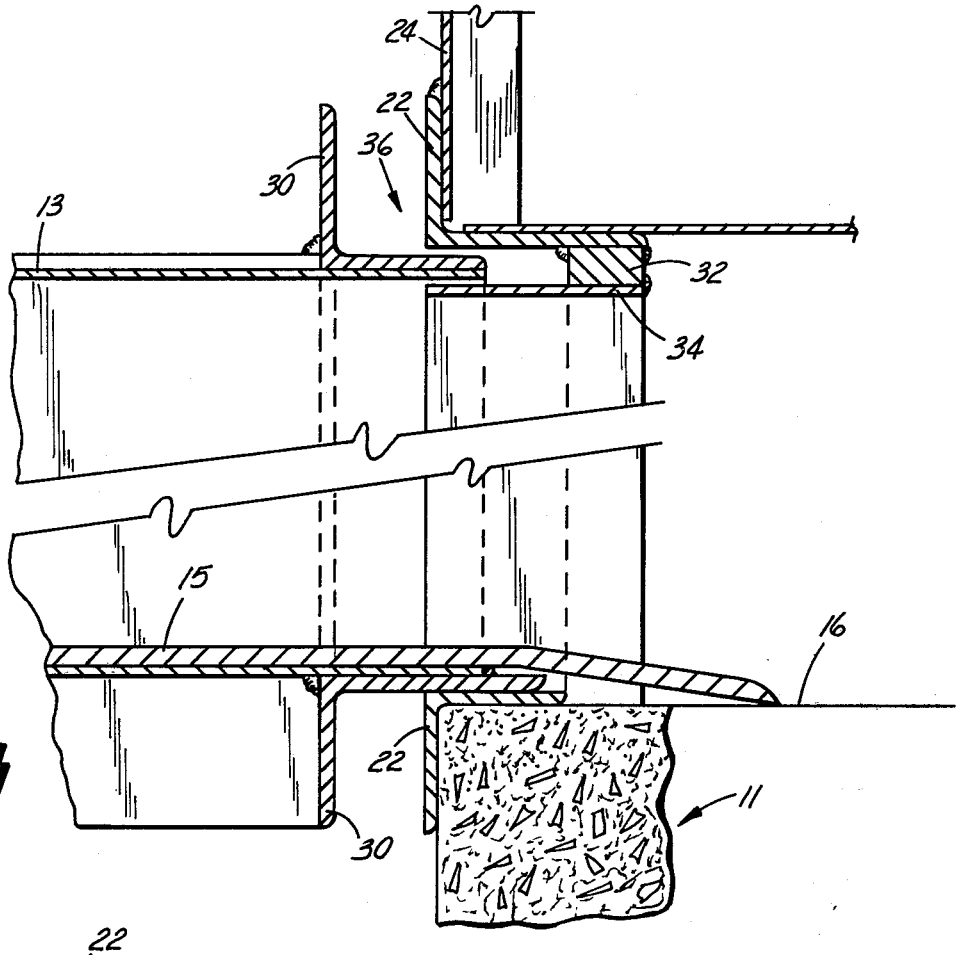
FIG. 3 is a cross-sectional view of a chute and door frame made in accordance with the present invention.

FIG. 3 further illustrates, in detail, the connection of the inner frame 22 and frame 30 of the chute. As noted above, the frame 30 fits inside the inner frame 22. At the floor 16 of the building the angle iron inner frame 22 merely rests on the floor 16 allowing the floor 15 of the chute 13 to pass over and into the building. The top and sides of the inner frame 22 have an additional box-like structure permanentaly attached thereto.

A metal bar 32 is permanently secured, as by welding, to the innermost edge of the angle iron inner frame 22. The bar 32 extends into the opening for the chute 13 on both sides and the top. The dimension of the bar 32 with respect to the distance the bar extends into the opening corresponds to the thickness of the edge of the chute 13 including the frame 30.

Figure 4:
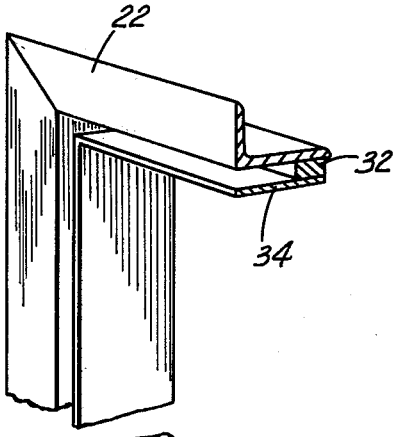
FIG. 4 is a perspective view, partially in cross-section, of a door frame made in accordance with the present invention.
Figure 4:
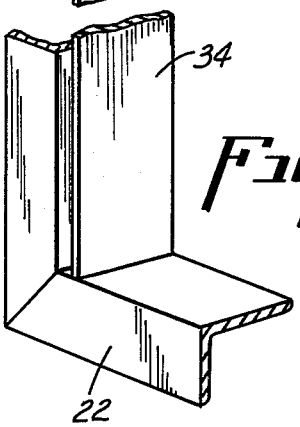

An inner protector 34, preferably of metal, is permanently affixed, as by welding, to the bar 32. The inner protector 34 is of a width generally equivalent to the inner frame 22. The effect of the inner protector 34, inner frame 22 and and bar 32 is to form a box-like structure open at one end. The open end of the inner frame 22, as noted above, is intended to allow insertion of the chute 13 and frame 30. FIG. 4 is extremely helpful in understanding the box-like nature of the inner frame 22, bar 32 and inner protector 34.

FIGS. 2 and 3 illustrate the static condition of the chute 13 with respect to the building 11. Static condition is intended to imply that the dumpster 18 has been positioned and jostling of the chute 13 should nor occur. In this regard, the chute 13 and frame 30 are shown only partially inserted into the box-like structure of the inner frame 22. This partial insertion effects a sealing of the exterior environment from within the chute and building. While this sealing is not airtight, it does prevent the direct influx of environment, i.e. air or dirt.

It is primarily this sealing arrangement with which this invention is concerned. This is the portion of the disposal system 10 referred to as a slip joint for the disposal chute, frame 30, inner frame 22, bar 32 and inner protector 34, together indicated generally at 36. The most extreme edge of the chute 13 and frame 30 is arranged to be removed from the bar 32 a short distance while still maintaining the frame 30 within the confines of the slip joint 36.

When the dumpster 18 has been filled with scrap or waste material to its capacity, it is removed as noted above. Another, empty dumpster is replaced adjacent to the chute 13. During the removal and replacement of dumpsters, the disposal system 10 is subject to considerable jostling or movement. During any such movement, the slip joint 36 allows inward movement of the chute 13 freely up to the bar 32. As noted above, even after the frame 30 has contacted the bar 32, the sheet metal 24 and supports 23 surrounding the chute withstand considerable movement with only temporary flexing. Thus, considerable relative movement of the disposal system 10 is possible without permanent damage being done to the building.

It should be noted, with respect to the disposal system 10 portrayed in FIGS. 1 and 2, that the packer 17 is not an absolutely necessary portion of the overall system. The chute 13 may be designed to allow direct access to the dumpster 18 without the necessity of forcing the scrap into the dumpster at the bottom.

Modifications, changes and improvements to the preferred forms of the invention herein disclosed, described and illustrated may occur to those skilled in the art who come to understand the principles and precepts thereof. Accordingly, the scope of the patent to be issued hereon should not be limited to the particular embodiments of the invention set forth herein, but rather should be limited by the advance by which the invention has promoted the art.

What is claimed is:

1. In a system for collection of waste materials including a container having a truck engaging means for removing, replacing and emptying the container, said container having an opening, a building having an opening, a chute, and support means for said chute positioned in spaced relation to said building, said building and said support supporting said chute in such a way as to allow slight axial movement of said chute during removal and replacement of said container, an improvement comprising said chute having a first open end, said opening of said container connected to said first open end of said chute, said chute having a second open end substantially smaller than said building opening, said second open end of said chute and said building opening arranged in spaced apart relationship, and seal means enclosing said building opening to said second open end of said chute, said seal means having slip joint means allowing said axial relative movement between said chute and said building opening.

2. The improvement according to claim 1 wherein said seal means includes an at least partially flexible panel covering the building opening to said second open end of the chute.

3. The improvement according to claim 2 wherein said seal means is constructed of sheet metal and angle iron.

4. The improvement according to claim 1 wherein said second open end of said chute is of a size sufficient to allow an operator to walk therethrough.

5. The improvement according to claim 1 wherein said slip joint includes first joint means affixed to said second open end of said chute and second joint means affixed to said seal means, said first and second joint means interconnecting to absorb relative movement between said chute and said building.

6. In a system for collecting waste materials, temporary storage and elimination, the combination of a container including truck engaging means for removing, replacing and emptying the container, said container having an opening, a building with an opening, a chute with first and second openings, support means for said chute positioned in spaced relation to said building opening, said building and said support supporting said chute in such a way as to allow slight axial movement of said chute during removal and replacement of said container, means connecting the first opening of said chute and the opening in said container, said second opening of said chute and said building opening arranged in spaced apart relationship, and seal means connecting said second opening of said chute to said building opening, said seal means including compression means whereby axially relative movement between said chute and said building is absorbed by said compression means without damage to said building.

7. The combination according to claim 6 wherein said compression means includes first joint means affixed to said second opening of said chute and second joint means affixed to said seal means, said first and second joint means interconnecting to absorb relative movement between said chute and said building.

8. The combination according to claim 6 wherein said chute includes a trash well adjacent to said first opening in said chute, ram means within said trash well, and hydraulic means forcing the ram means through said trash well forcing waste material into said container.

9. An apparatus for permanently sealing a building entrance to a trash container having truck engaging means for removing, replacing and emptying said container, comprising a chute with first and second openings, support means for said chute positioned in spaced relation to said building, said building and said support supporting said chute in such a way as to allow slight axial movement of said chute during removal and replacement of said container, said first opening of said chute adapted for access to said trash container, said second opening of said chute positioned within said building entrance, said second opening of said chute and said building entrance arranged in spaced apart relationship, sealing means positioned between said building entrance and said second opening of said chute, first joint means affixed to said second opening of said chute, and second joint means affixed to said sealing means, said first and second joint means interconnected to absorb relative movement between said chute and said building.

* * * * *